United States Patent [19]

Gossie

[11] 3,970,508

[45] July 20, 1976

[54] DECAL SMOOTHING APPARATUS

[75] Inventor: Mijo A. Gossie, Corning, N.Y.

[73] Assignee: Corning Glass Works, Corning, N.Y.

[22] Filed: Feb. 26, 1975

[21] Appl. No.: 553,176

[52] U.S. Cl. ..... 156/477 R; 156/486; 156/556; 156/DIG. 42

[51] Int. Cl.[2] ..... B65C 9/36

[58] Field of Search ..... 156/389, 475, 485–488, 156/556, 582, 212, DIG. 42, 491, 477 R, 481; 74/230

[56] References Cited

UNITED STATES PATENTS

| | | | |
|---|---|---|---|
| 1,239,066 | 9/1917 | Winters | 74/230 |
| 1,299,324 | 4/1919 | Goodykoontz | 74/230 |
| 2,056,451 | 10/1936 | Haberstump | 156/487 |
| 2,441,164 | 5/1948 | Miller | 156/212 |
| 2,536,210 | 1/1951 | Ort et al. | 156/486 |

*Primary Examiner*—Douglas J. Drummond
*Assistant Examiner*—M. G. Wityshyn
*Attorney, Agent, or Firm*—Charles W. Gregg; Burton R. Turner; Clarence R. Patty, Jr.

[57] ABSTRACT

An assembly or apparatus for smoothing and removing bubbles of air or a solvent, such as water, for example, from between the transfer films of decals and the upwardly disposed surfaces of dish-like articles such as pieces of dish-like pottery ware, glass or glassceramic ware or the like to whose upper surfaces the transfer films have been applied as by hand or by a decal applying apparatus such as is well known in the art. The assembly comprises at least one stellate, stelliform, or star-like wheel including a plurality of rays or radial fingers of a resilient material such as rubber, for example, and the wheel or wheels are actuated and rotated so that the tips of the rays or fingers move across the transfer film, applied on a surface of a dish-like article, with a wiping or brushing squeegee-like action or operation to smooth the film and remove bubbles entrapped between the film and such surface of the article.

4 Claims, 8 Drawing Figures

Fig. 4
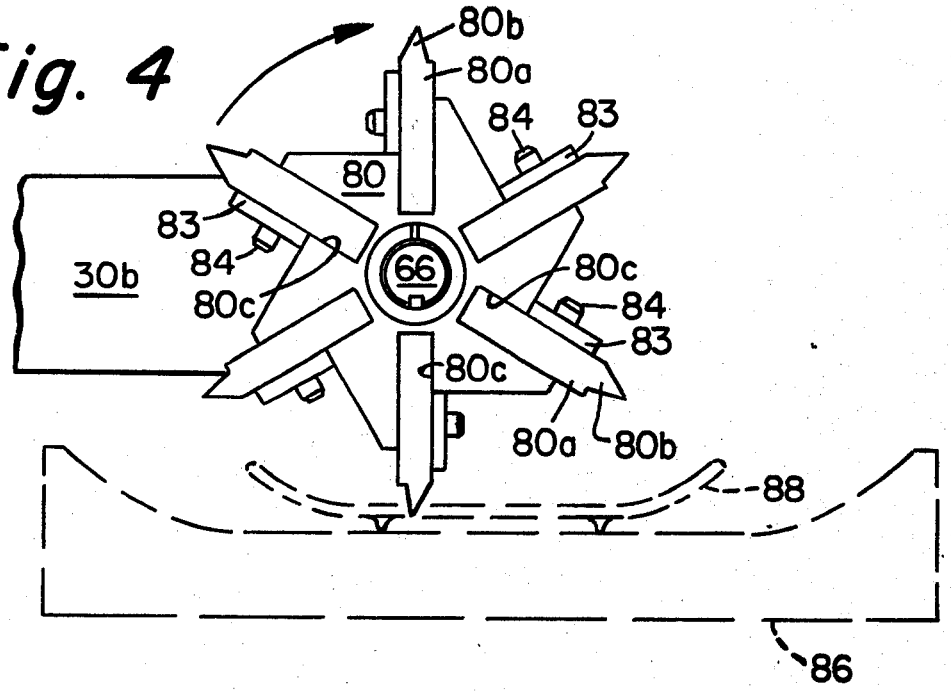
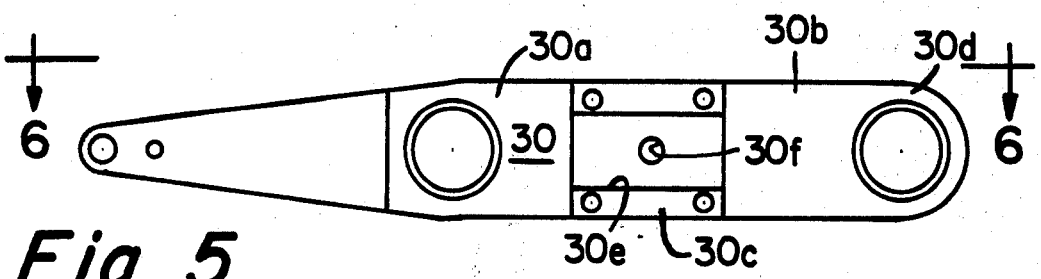
Fig. 5
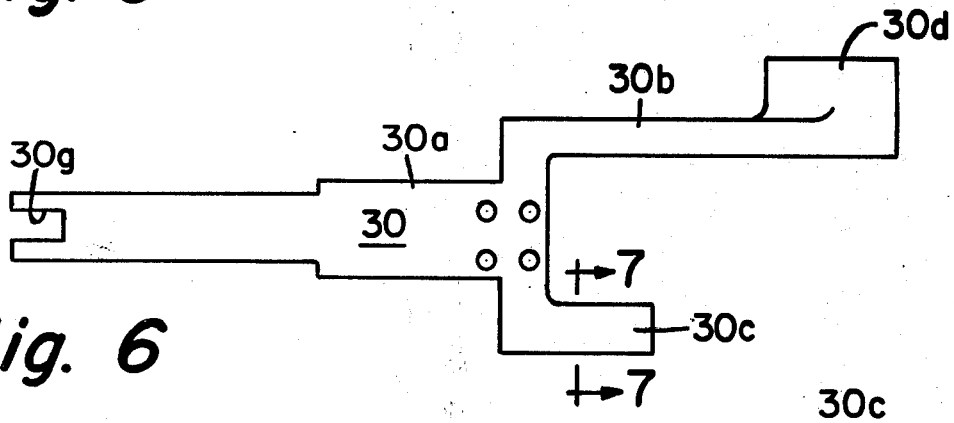
Fig. 6
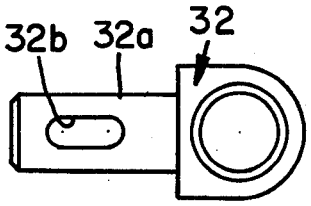
Fig. 8
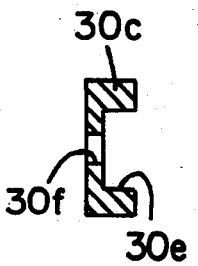
Fig. 7

DECAL SMOOTHING APPARATUS

BACKGROUND OF THE INVENTION

Heretofore, in the transfer or application of transfer films of decals to surfaces to be decorated, such films have usually been smoothed by hand with the aid of a squeegee or similar device to remove blisters or wrinkles and bubbles of air or of a solvent, such as water, which may exist or occur between said films and the surfaces to which such films are applied. The performance of such manual operations to smooth said transfer films and remove said bubbles etc. is relatively slow, difficult and uneconomical and, therefore, the apparatus of the present invention was developed to provide for faster and more economical decal smoothing, that is, automatic smoothing of the transfer films of the decals.

BRIEF SUMMARY OF THE INVENTION

The apparatus of the invention is believed to be adequately summarized in the foregoing abstract of the disclosure and, therefore, to avoid repetition or redundancy to the extent possible, no further summary of the invention will be given nor is any believed necessary.

BRIEF DESCRIPTION OF THE DRAWINGS

In the Drawings:

FIG. 4 comprises an elevational view of a component of the apparatus of the invention, such view being taken generally along line 4—4 of FIG. 1 and schematically illustrating the smoothing of a decal transfer film on a small diameter size piece of a dish-like article or piece of ware;

FIG. 5 is a side elevational detail view of a part of the apparatus of the invention;

FIG. 6 is a top plan view of the apparatus part of FIG. 5, such view being taken generally along line 6—6 of FIG. 5;

FIG. 7 is a cross-sectional view of a portion of the apparatus part of FIGS. 5 and 6, such view being taken generally along line 7—7 of FIG. 6; and FIG. 8 is an elevational detail view of another part of the apparatus of the invention.

Similar reference characters refer to similar parts in each of the FIGS. of the drawings.

PREFERRED EMBODIMENTS OF THE INVENTION

Figure 1:
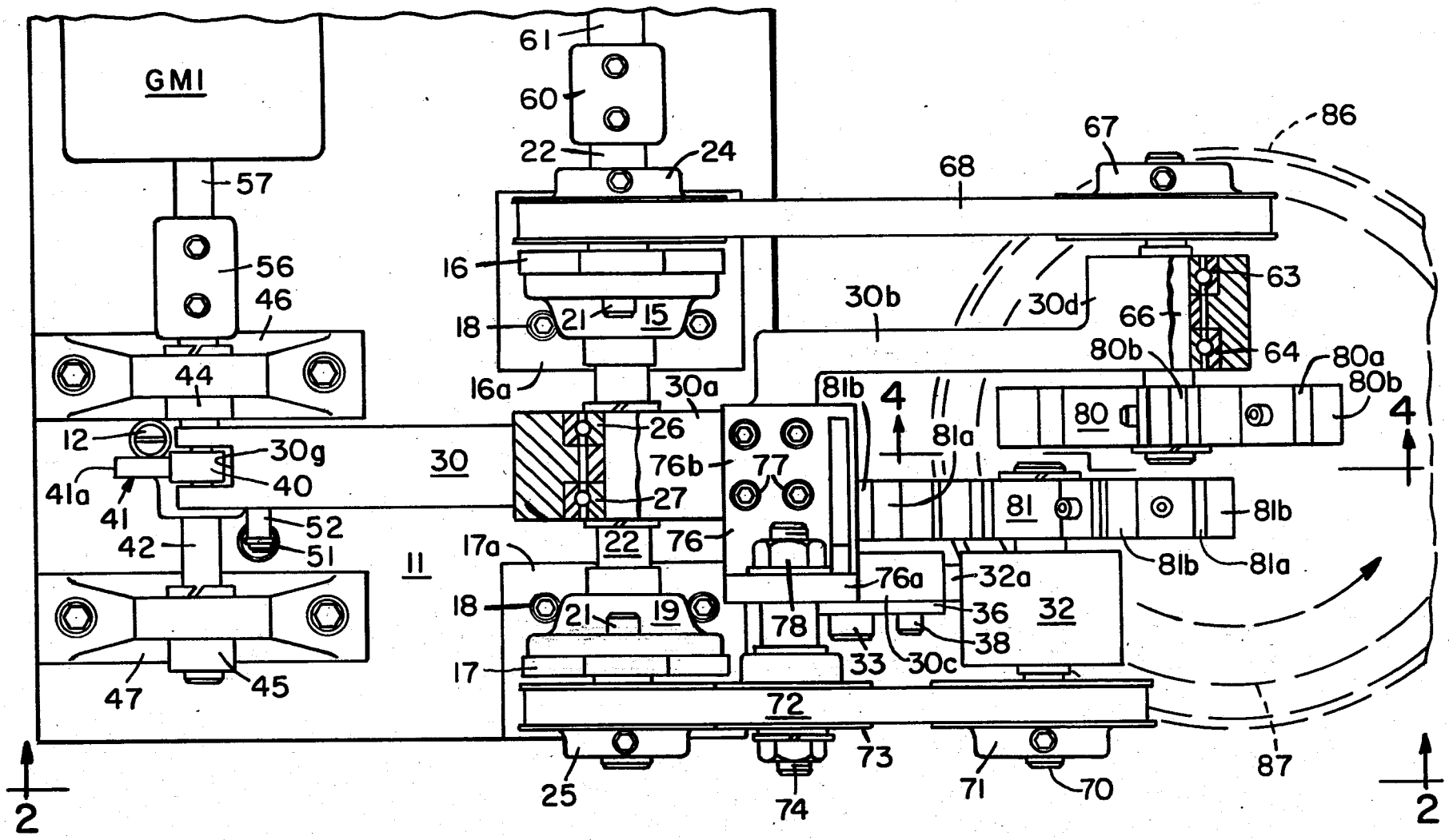
FIG. 1 is a top plan view of one form of apparatus embodying the invention.
Figure 2:
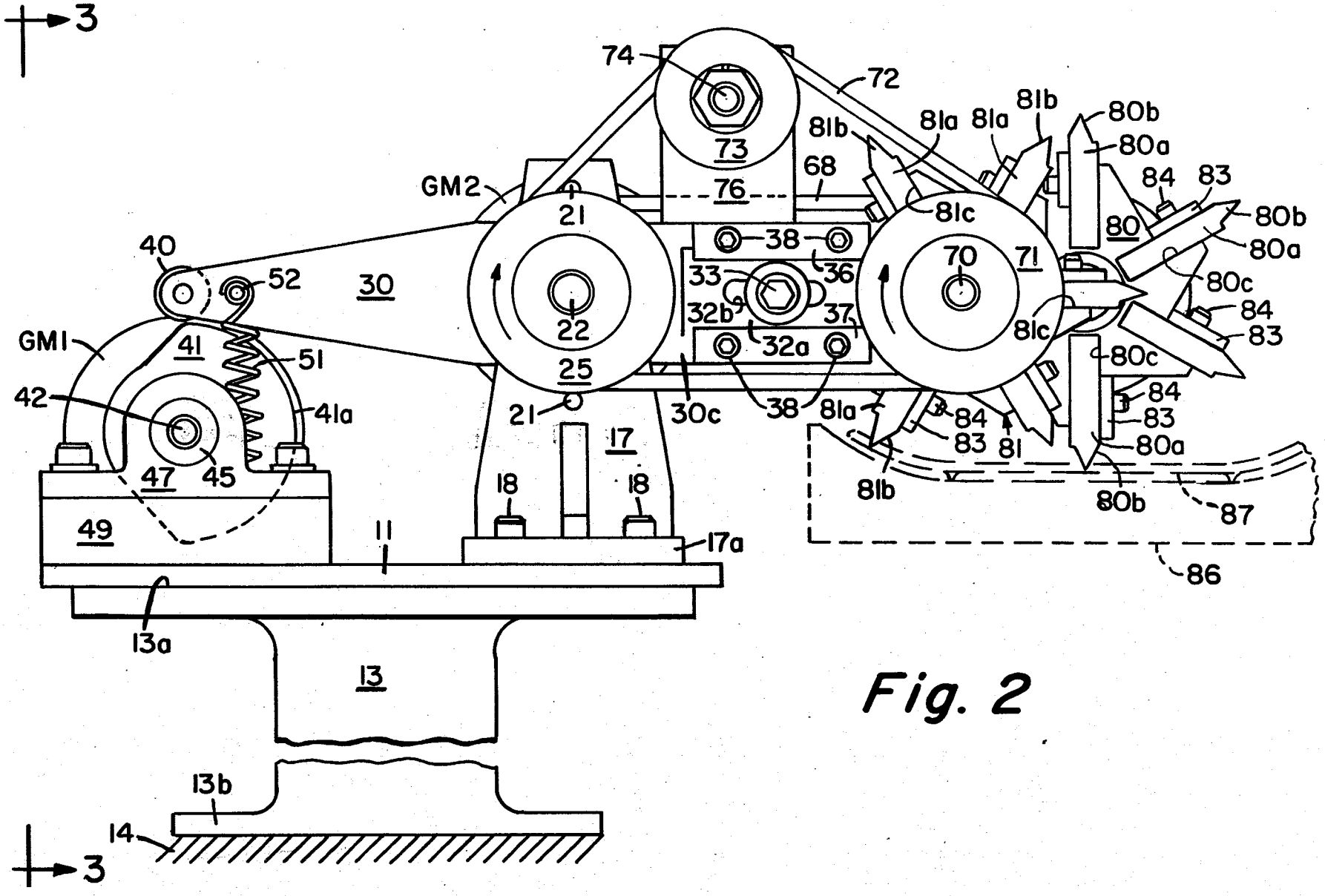
FIG. 2 is a side elevational view of the apparatus of FIG. 1, such view being taken generally along line 2—2 of FIG. 1.
Figure 3:
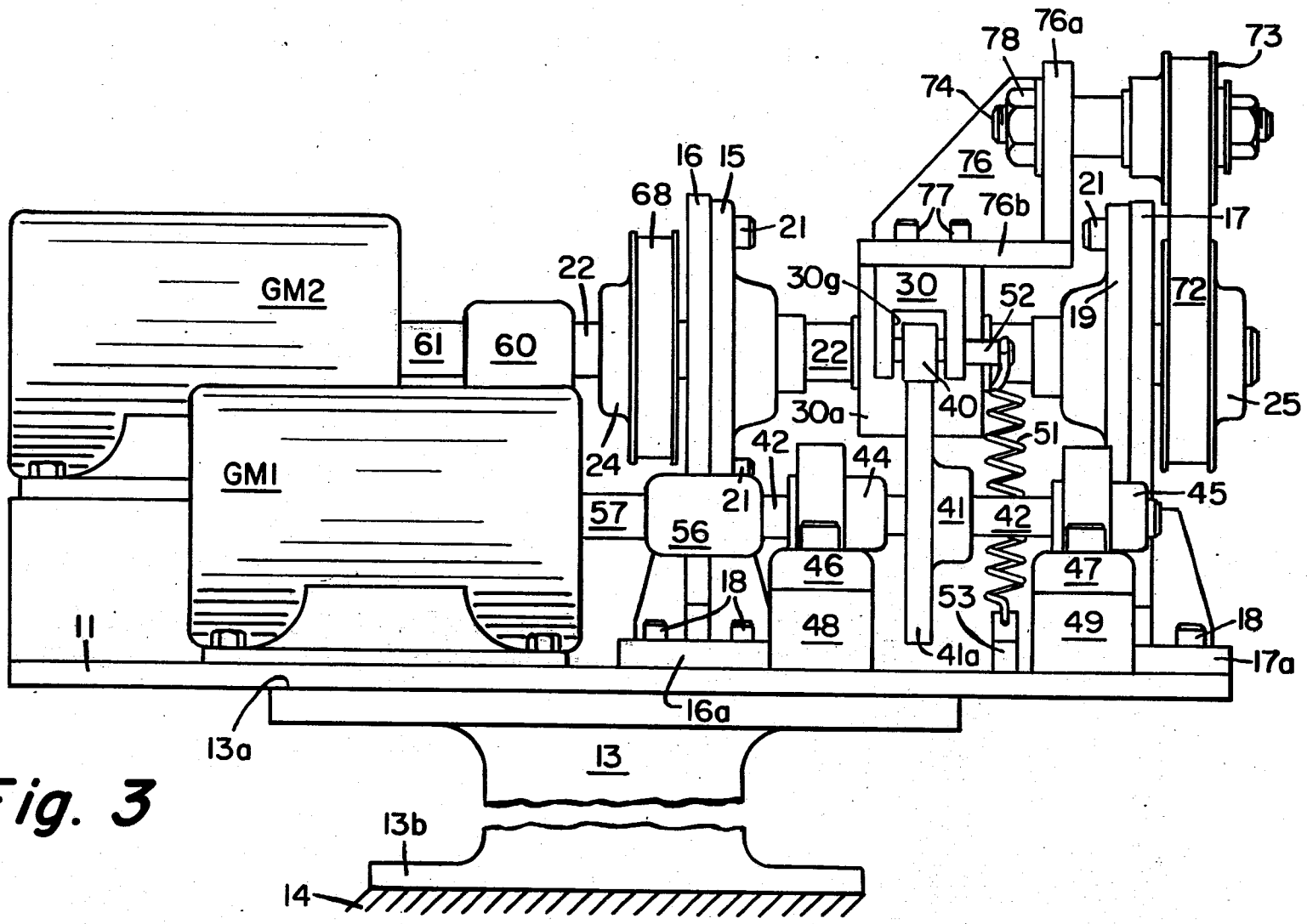
FIG. 3 is an end elevational view of the apparatus of FIG. 1, such view being taken generally along line 3—3 of FIG. 2.

Referring to the drawings in detail there is shown in FIGS. 1, 2 and 3 an apparatus support plate 11 which is secured as by a plurality of counter-sunk screws, such as 12 (FIG. 1) to the upper flat surface 13*a* of a support pedestal 13 whose foot 13*b* rests on and is secured to a floor, or the top of a suitable support platform or table 14. First and second upright support brackets 16 and 17 having feet such as 16*a* and 17*a*, respectively, are secured, as by bolts such as 18, to the upper surface of suppot plate 11. First and second cartridge type bearings 15 and 19, respectively, are secured as by bolts such as 21, to the right hand and left hand faces (viewing FIG. 3) of support brackets 16 and 17, respectively.

A shaft or axle 22 extends through suitable holes (not shown) provided in support brackets 16 and 17, and through said cartridge bearings 15 and 19, such shaft being rotatably supported by such bearings. A first pulley 24 is disposed on and is keyed to shaft 22 adjacent the left hand end thereof (viewing FIG. 3) for driven rotation therewith. Similarly, a second pulley 25 is disposed on and is keyed to shaft 22 adjacent the right hand end thereof (viewing FIG. 3) for driven rotation therewith. Shaft 22 also extends through the inner races of a pair of ball-bearings 26 and 27 (FIG. 1) whose outer races are contained in a hub portion 30*a* of a lever arm 30, such hub portion being located at about the center of the length of such lever arm as discussed below.

Lever arm 30 is shown in detail in FIGS. 5, 6 and 7, and such arm is forked or bifurcated, that is, is divided into two parts or branches 30*b* and 30*c* just to the right (viewing FIGS. 1, 5 and 6) of the aforesaid hub portion 30*a* of the lever arm. Bifurcation 30*b* is relatively long and includes a hub portion 30*d* at its free end, that is, at the right hand end thereof when viewing FIGS. 1, 5 and 6. The purpose of hub portion 30*d* is discussed hereinafter. Bifurcation 30*c* is relatively short (as compared to bifurcation 30*b*) and such bifurcation embodies a channel or recess 30*e* (FIGS. 5 and 7) which extends the length of such bifurcation. The purpose of recess 30*e* is discussed below.

There is shown in FIG. 8 (as well as FIG. 1) a hub 32 which is similar to the aforesaid hub portion 30*d* of bifurcation 30*b* of lever arm 30. Hub 32 has extending from the left side thereof (viewing FIG. 8) an integral support arm 32*a*, such support arm fitting snugly but slidably into the aforesaid channel or recess 30*e* provided in bifurcation 30*c* of lever arm 30, as best illustrated in FIG. 2. Arm 32*a* is provided with a slot 32*b* (FIGS. 2 and 8) and a bolt 33 (FIGS. 1 and 2) extends through slot 32*b* and is screwed into a threaded hole 30*f* (FIGS. 5 and 7) provided in bifurcation 30*c* of lever arm 30 as shown in FIG. 2. As also illustrated in FIG. 2 a pair of upper and lower guide plates 36 and 37 are bolted by bolts such as 38 to bifurcation 30*c* and such plates overhang recess 30*e* to help guide support arm 32*a* of hub 32 within such recess as well as to aid in retaining such support arm within the recess 30*e*. By the arrangement just described it will be apparent that a means are provided for adjustably moving hub 32 in directions horizontally closer to or further away from hub 30*a* of lever arm 30, that is, when viewing FIG. 1, in directions horizontally to the left or to the right, such movements or adjustments being accomplished by loosening bolt 33, manually moving hub 32 in the desired direction and then retightening such bolt to maintain hub 32 in its new position. The purpose of such arrangement will become apparent as the description proceeds.

The second end of the lever arm 30, that is, the end of such arm opposite the bifurcations 30*b* and 30*c*, is provided with a slot 30*g* (FIGS. 1, 3 and 6) in which there is rotatably supported a cam follower or roller 40 whose outer periphery bears against the outer periphery or rim 41*a* of a rotary cam or cam wheel 41, such outer periphery or rim 41*a* of such cam or cam wheel 41 having or including thereon high and low regions at selected maximum and minimum distances from the pivotal center of the cam or cam wheel, such cams or cam wheels being well known in the art. Cam or cam wheel 41 is keyed to a shaft or axle 42 for rotation therewith, and the left and right hand ends (viewing FIG. 3) extend through sleeve bearings 44 and 45, respectively, for rotation therein. Sleeve bearings 44 and 45 are supported in pillow blocks 46 and 47, respectively, such pillow blocks being secured to the upper surfaces of spacer blocks 48 and 49, respectively, which are secured to the upper surface of the aforesaid support plate 11.

As best illustrated in FIG. 3, a tension spring 51 has an upper or first end extending partially about a suitable pin 52 adjacent a first or otherwise free end thereof and the second end of such spring extends through a suitable anchoring device 53 secured in any suitable manner to the upper surface of support plate 11. The second end of pin 52 is secured in a suitable hole provided in lever arm 30 near said second end of such arm. As is believed obvious, spring 51 is constantly under tension and thereby maintains the outer periphery of cam follower 40 constantly in contact with the outer periphery or rim 41*a* of cam or cam wheel 41.

The left hand end (viewing FIG. 3) of axle or shaft 42 extends into the right hand end of a sleeve coupling 56 into whose left hand end there extends the output shaft 57 of a first gear motor GM1. Sleeve coupling 56 is keyed to shafts 42 and 57 for rotation thereof and thereby, respectively, and, when motor GM1 is energized, shaft 42 is thereby rotated to, in turn, impart rotation to cam or cam wheel 41, as will be readily apparent to those skilled in the art.

Returning to the aforesaid shaft or axle 22 which is rotatively supported in and by cartridge bearings 15 and 19, the left hand end (viewing FIG. 3) of axle or shaft 22 extends into the right hand end of a sleeve coupling 60 into whose left hand end there extends the output shaft 61 of a second gear motor GM2. Sleeve coupling 60 is keyed to shafts 22 and 61 for rotation thereof and thereby, respectively, and, when motor GM2 is energized, shaft 22 is thereby rotated to, in turn, impart rotation to the aforesaid pulleys 24 and 25 keyed to shaft 22 for rotation therewith, as is also believed apparent.

Returning to hub portion 30*d* (FIG. 1) of bifurcation 30*b* of lever arm 30, there is disposed in such hub portion a pair of ball bearings 63 and 64 (FIG. 1) through whose inner races there extends an axle or shaft 66 for rotation of such axle in the hub portion 30*d*. A pulley 67 is keyed to a first end of shaft 66 for rotation of such shaft, such pulley having looped thereabout a drive belt 68 which is also looped about previously mentioned pulley 24 for driven movement of such belt by rotation of pulley 24. Returning to hub 32 (FIG. 1) there is disposed in such hub a pair of ball bearings similar to ball bearings 63 and 64 in hub portion 30*d* of bifurcation 30*b* of lever arm 30, such ball bearings in hub 32 not being shown in the drawings for purposes of simplification thereof. An axle or shaft 70 extends through the inner races of the bearings in hub 32 for rotation in such hub and a pulley 71 is keyed to a first end of shaft 70 for rotation of such shaft, such pulley having looped thereabout a drive belt 72 which is also looped about previously mentioned pulley 25 for driven movement of such belt by rotation of pulley 25 and such belt 72 also being looped about an idler pulley 73 discussed below.

The above mentioned idler pulley 73 is rotatably mounted on a suitable bearing (not shown) carried on a short shaft or axle 74 and is free to rotate on such bearing and shaft adjacent one end thereof. The second end of shaft 74 is secured in a vertical slot (not shown) provided in the upright part 76*a* of an L-shaped bracket 76 whose base or foot 76*b* is secured to the upper surface of lever arm 30 as by bolts such as 77 (FIG. 1). A nut 78 on the second end of shaft 74 holds such shaft in said vertical slot. Such arrangement provides, in conjunction with slot 32*b* in support arm 32*a* of hub 32, a means permitting pulley 71 to be moved or adjusted horizontally without the necessity of changing belt 72 to a different size belt. That is to say, nut 78 can be loosened to permit upward and downward adjustments of idler pulley 73 when the aforementioned bolt 33 is loosened to permit horizontal adjustment of pulley 71 in left or right hand directions, respectively (viewing FIG. 2). After an adjustment of pulley 71 to its desired horizontal position, bolt 33 is tightened and pulley 73 is then vertically moved to tighten belt 72. Nut 78 is then tightened to hold pulley 73 in its adjusted vertical position and provide the desired or necessary tautness of belt 72.

As shown in FIGS. 1, 2 and 4, first and second stelliform or stellate wheels 80 and 81, respectively, are mounted on shafts 66 and 70, respectively, adjacent the second ends of such shafts. Such wheels are keyed to their respective shafts 66 and 70 for driven rotation thereby when rotation is imparted to such shafts by belts 68 and 72, respectively, being driven by pulleys 24 and 25, respectively, as will be apparent to those skilled in the art. The stellate or star-like wheels 80 and 81 each include a plurality of similar radial finger or rays 80*a* and 81*a*, respectively, which are made of a resilient material such as rubber for example, each said ray or radial finger having a tapered or wedgeshaped end such as 80*b* and 81*b*. As best illustrated in FIG. 4, each ray or radial finger such as 80*a* and 81*a* extends into a recess such as 80*c* and 81*c* provided in the central portion of each respective wheel 80 and 81, respectively, and the rays or radial fingers are each held in one of such recesses by a rubber clamping plate such as 83 and a bolt such as 84, each such bolt extending through the respectively associated clamping plate and into a threaded hole provided in the central portion of the respective wheel 80 or 81. The structure of each of the wheels 80 and 81 will be readily apparent to those skilled in the art from the above description taken in conjunction with FIG. 4 as well as in conjunction with FIGS. 1 and 2 of the drawings.

As previously mentioned, the apparatus or assembly of the present invention is employed for the purpose of smoothing and removing bubbles of air or a solvent, such as water, from between transfer films of decals and the upwardly disposed surfaces of dish-like articles such as pieces of glass-ceramic or pottery dinner ware, or the like, to or on which said transfer films are applied. To this end the apparatus or assembly is disposed adjacent a suitable transform film smoothing station, that is, adjacent a dwell station in a path of travel through which the pieces or articles of ware are successively and intermittently conveyed by rotary ware holders or vacuum chucks such as illustrated by the broken line outlined figures shown in FIGS. 1, 2 and 4 and designated 86. In FIGS. 1 and 2 rotary vacuum chuck 86 is illustrated as carrying an article or a piece of ware such as, for example, a dinner plate 87 of a relatively large diameter. In FIG. 4 the rotary vacuum chuck 86 is illustrated as carrying an article or a piece of ware 88 of a smaller diameter than the dinner plate 87. It is pointed out that the rotary vacuum chucks such as 86, as well as the apparatus for moving such chucks through the aforesaid path of travel, do not, per se, form any part of the present invention but are shown in order to make the utility of the invention clear or more readily understood.

When the decal transfer film on each of a succession of small diameter articles such as 88 shown in FIG. 4 are being operated upon, that is, are receiving treatment or being smoothed by the apparatus of the present invention, only the first wheel 80 is employed for smoothing the decals on the articles such as 88 as illustrated in FIG. 4, the second wheel 81 being left off of or removed from the apparatus or assembly at such time. However, when the decal transfer films on a succession of large diameter articles such as 87 are being operated upon or treated, both wheels 80 and 81 are employed, as shown in FIGS. 1 and 2. Because of the thinness of the transfer films of decals no attempt has been made to illustrate such films on the upper surfaces of the articles or pieces of ware 87 and 88 shown in the drawings.

In use, the tips of the rays or radial fingers such as 80*a* and 81*a* of the stelliform or stellate wheels 80 and 81 smooth a decal transfer film by moving across the entire expanse of such film with a wiping or brushing squeegee-like action or motion, such wiping or brushing action or motion being from adjacent or just beyond the center of each respective piece of ware towards the rim or edge thereof. Therefore, wheel 80, or wheels 80 and 81 are rotated in the direction indicated by the arrows shown on pulley 71 in FIG. 2 and shown adjacent wheel 80 in FIG. 4, that is, when viewing FIGS. 2 and 4, wheels 80 and 81 are rotated in clockwise directions. The manner in which the tips of the rays or radial fingers smooth the aforesaid decal transfer films can be readily envisioned, by those skilled in the art, from a brief view of the articles or pieces of ware as shown in FIGS. 2 and 4.

As previously mentioned the vacuum chucks such as 86 are rotary vacuum chucks. Viewing such chucks from above (FIG. 1) the chucks rotate in counterclockwise directions and, therefore, the tips 80*b* of the rays or radial fingers 80*a* of first wheel or wheel 80 first wipe or brush across a transfer film on a piece of ware or article such as 87 from just beyond the center thereof to a region about half way towards the rim or edge of the dish-like article and, as chuck 86 rotates the article or piece of ware such as 87, the tips 81*b* of the rays or radial fingers 81*a* of the second wheel 81 wipe or brush across said transfer film from said halfway region, where the brushing or wiping action of the first wheel terminated, to the rim or edge of the article to perform a complete squeegee-like stroke across the film from adjacent the center thereof to the edge of the dish-like article. When, of course, the transfer film on a small article such as 88 (FIG. 4) is being smoothed or treated the first wheel 80 alone performs the wiping or brushing squeegee-like action on the transfer film, the tips 80*b* of the radial fingers or rays 80*a* of such wheel moving across said film from a point just beyond the center of the article 88 to the outer edge of such article.

The aforementioned gear motors GM1 and GM2 are selected to have gear ratios and to be energized to respectively rotate the aforesaid cam 41, and wheels 80 and 81, in accordance with the speed of rotation of a dish-like article such as 87 by a chuck such as 86, such chuck rotating each article such as 87 (or 88) at least a complete 360 degrees during the dwell period of said chuck at the transfer film smoothing station. Therefore, gear motor GM1 is energized so that cam follower 40 is contacting the lower region of the peripheral rim 41*a* of cam 41 when a chuck such as 86 is moving a piece of ware to or away from the smoothing station, and is contacting the high region of the peripheral rim of the cam when a chuck is dwelling at said station and is rotating a piece of ware at such staion. The low and high regions of cam 41 thus actuate lever arm 30 to move the wheels such as 80 and 81 upwardly and out of the path of travel of a chuck when cam follower 40 is contacting the low region of the cam and to move such wheels downwardly to their transfer film smoothing positions when the cam follower is contacting the high region of the cam.

Gear motor GM2 may be energized continuously or may be energized only when wheels 80 and 81 are moved to their transfer film smoothing positions. However, such motor must be energized so as to rotate wheels 80 and 81 at a speed such that the tips of the rays or radial fingers of the wheels perform their brushing or wiping squeegee-like action across the entire expanse of a transfer film during the period of rotation of the article or piece of ware whose upper surface is supplied with such film. It is believed that this will be readily apparent to those skilled in the art.

Although there is shown and described only one form of apparatus embodying the invention, it is to be understood that such is not to be considered in any way limiting but that various changes and modifications may be made therein within the purview of the appended claims without departing from the spirit and scope of the invention.

What is claimed is:

1. In an apparatus for automatically applying transfer films of decals to upwardly facing surfaces of pieces of dish-like pottery ware, glass or glass-ceramic ware, or the like, as each piece of ware is intermittently conveyed through a path of travel comprising a plurality of dwell stations including a film smoothing station, an assembly for smoothing and removing any air or solvent which is entrapped between said transfer films and said surfaces of said pieces of ware during the applying of said films, such assembly being disposed at said smoothing station and comprising, in combination, A. a lever arm pivotally supported adjacent its center for vertical reciprocative movement of the ends thereof, B. a cam follower rotatably supported on said arm adjacent a first end thereof, C. a stellate wheel including a plurality of radial fingers of a resilient material, such wheel being rotatably supported by said arm adjacent the second end thereof and above each piece of ware conveyed to and dwelling at said smoothing station so that said wheel can be periodically actuated downwardly and rotated to cause the tips of said radial fingers to contact and move with a wiping squeegee-like action across the transfer film on said upwardly facing surface of each piece of ware dwelling at the smoothing station, such movement of such fingers being in a direction extending generally radially from adjacent the center of each respective piece of ware towards the outer rim thereof, D. a rotary cam having a peripheral rim including thereon high and low regions at selected maximum and minimum distances from the pivotal center of the cam, such cam rotatably mounted on said assembly below said cam follower, E. spring means for forcing said first end of said lever arm in a direction to maintain the peripheral rim of said cam follower in contact with said peripheral rim of said cam, F. means for imparting rotation to said cam for periodic actuation of said second end of said lever arm and, thereby, said stellate wheel to a downward position and the tips of said radial fingers thereof into contact with the transfer film on each respective piece of ware dwelling at the smoothing station and being rotated thereat, and G. means for imparting rotation to said wheel to provide said wiping squeegee-like action of said tips of said radial fingers when such wheel is in its said downward position.

2. An assembly in accordance with claim 1 and further including,

I. a second stellate wheel similar to the first stellate wheel and located partially therebeside, such second wheel being rotatably supported by said lever arm with the axis of rotation of the second wheel being generally horizontally offset from the axis of rotation of the first wheel, such offset being in a direction toward the center of said lever arm and II. means for imparting rotation to said second wheel to provide wiping squeegee-like action of the tips of the radial fingers of such second wheel, such wiping action supplementing the reach of the tips of the fingers of the first wheel and enabling the assembly to smooth decal transfer films on the upwardly facing surfaces of pieces of ware having larger diameters than the maximum diameters of pieces of ware whose decal transfer films can be smoothed by the first stellate wheel alone.

3. An apparatus for smoothing and removing bubbles from between the transfer film of a decal and a surface of a circular dish-like article to which such transfer film has been applied, such article being supported on a rotating horizontal vacuum chuck with said surface facing upwardly, such apparatus comprising, in combination, A. a lever arm pivotally supported adjacent its center and pivotally supporting, adjacent first and second ends thereof, respectively, a rotatable cam follower roller and a rotatable stelliform wheel including a plurality of similar rays of a resilient material, B. a rotary cam having a peripheral rim including high and low regions thereon, C. spring means connected to said lever arm for maintaining the outer periphery of said cam follower roller in contact with said peripheral rim of said cam, D. means for mounting said lever arm adjacent said chuck with said stelliform wheel above said dish-like article and the center of such wheel in near vertical alignment with the center of such article, the tips of said rays of such wheel contacting said decal transfer film on said surface of the article only when said outer periphery of said cam follower is in contact with said high region of said cam, E. means for periodically rotating said cam, and F. means for rotating said stelliform wheel to cause said tips of said rays to move across said transfer film from adjacent the center of said dish-like article towards the rim thereof when said cam follower is in contact with said high region of said cam, such movement of said tips performing a brushing squeegee-like operation on said transfer film.

4. An apparatus in accordance with claim 3 and further including

I. a second rotatable stelliform wheel similar to the first mentioned wheel, such wheel being rotatably supported by said arm adjacent to and parallel with said first wheel but at a lesser distance from said pivotal center of said lever arm than such first wheel, and II. means for rotating said second wheel to cause the tips of the rays thereof to move across said transfer film to the rim of said dish-like article to supplement said brushing squeegee-like operation of said first wheel, whereby said apparatus can smooth transfer films on larger diameter dish-like articles than can be smoothed by said tips of said rays of said first mentioned stelliform wheel alone.

* * * * *